US008512481B2

(12) United States Patent
Rondon et al.

(10) Patent No.: US 8,512,481 B2
(45) Date of Patent: Aug. 20, 2013

(54) PRESS CLEANING WITH LOW-VOC SOLVENT COMPOSITIONS

(75) Inventors: Sonia Rondon, Nashua, NH (US); Kevin Ray, Windham, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 12/910,641

(22) Filed: Oct. 22, 2010

(65) Prior Publication Data

US 2012/0097185 A1 Apr. 26, 2012

(51) Int. Cl.
*B08B 7/00* (2006.01)

(52) U.S. Cl.
USPC ..... 134/26; 134/2; 134/6; 134/18; 134/36; 134/38; 134/42; 510/175; 510/407; 510/413

(58) Field of Classification Search
USPC ..... 510/175, 413, 407; 134/2, 6, 18, 134/36, 38, 42, 26
See application file for complete search history.

(56) References Cited

U.S. PATENT DOCUMENTS

| | | | | |
|---|---|---|---|---|
| 5,156,760 | A * | 10/1992 | Marchese et al. | 510/214 |
| 5,194,173 | A | 3/1993 | Folkard et al. | |
| 5,213,624 | A * | 5/1993 | Williams | 134/40 |
| 5,230,821 | A | 7/1993 | Larson et al. | |
| 5,340,493 | A | 8/1994 | Principato | |
| 5,340,495 | A | 8/1994 | Mulcahy et al. | |
| 5,728,672 | A | 3/1998 | Richter | |
| 5,814,163 | A | 9/1998 | Wojcik | |
| 6,284,720 | B1 | 9/2001 | Opre | |
| 6,367,010 | B1 | 4/2002 | Venkatram et al. | |
| 2008/0207494 | A1 | 8/2008 | Chang et al. | |
| 2008/0280801 | A1 | 11/2008 | Dabela et al. | |
| 2008/0280802 | A1 * | 11/2008 | Dabela et al. | 510/170 |
| 2008/0287331 | A1 | 11/2008 | Lin et al. | |
| 2009/0281012 | A1 * | 11/2009 | Trivedi et al. | 510/138 |
| 2010/0273695 | A1 * | 10/2010 | Sehgal et al. | 510/174 |

FOREIGN PATENT DOCUMENTS

| | | | |
|---|---|---|---|
| EP | 0174711 | * | 3/1986 |
| WO | WO 92/18600 | | 10/1992 |
| WO | 94/17144 | | 8/1994 |
| WO | 94/17145 | | 8/1994 |
| WO | WO95/14755 | * | 6/1995 |
| WO | WO 01/59059 A1 | | 8/2001 |

OTHER PUBLICATIONS

Dow Chemical Company, Oct. 11, 2010. "Product Safety Assessment, Dow Nonylphenol Ethoxylate Surfactants", pp. 1-9.*
International Search Report and written opinion for international patent application No. PCT/US2011/056687, filed on Oct. 18, 2011.

* cited by examiner

*Primary Examiner* — Bibi Carrillo
(74) *Attorney, Agent, or Firm* — Bingham McCutchen LLP

(57) ABSTRACT

Low-VOC cleaning compositions effective in removing stubborn UV inks from printing-press components include at least one non-ionic surfactant selected from the group consisting of a sorbitan ester, an ethoxylated sorbitan ester, an ethoxylated castor oil, polyethylene glycol ester and an alcohol ethoxylate; and at least one carrier comprising or consisting essentially of at least one of (i) an organic solvent miscible therewith or (ii) D-limonene. The cleaning composition has a VOC limit less than 100 g/L.

8 Claims, No Drawings

PRESS CLEANING WITH LOW-VOC SOLVENT COMPOSITIONS

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

Various types of inks are used in commercial lithographic printing presses, and three press components make repeated contact with ink: the printing member itself, inking rollers, and the blanket cylinder. As a result, these components require cleaning between print jobs or during maintenance. The printing member is cleaned as it is readied for use, e.g., by exposure to fountain solution, while the inking rollers and offset blanket are typically cleaned with a press cleaner (often referred to as "press wash," or "roller and blanket wash"). Conventional press-cleaning compositions contain petroleum-based solvents such as naphtha, mineral spirits, toluene and/or xylene. Such solvents release volatile organic compounds, or "VOCs"—i.e., carbon-containing materials that evaporate into the air. VOCs are environmentally deleterious, contributing to the formation of smog and posing potential toxicity hazards.

In addition, solvents having high VOC contents (50 to 100%) may often penetrate the offset blanket and cause it to swell, increasing its thickness and potentially leading to changes in impression pressure that create printing defects. Unfortunately, high-VOC compositions are particularly effective in removing ink.

Low-VOC press-cleaning agents with acceptable performance have been introduced, but these tend to work best with heat-set or cold-set inks. Inks curable by exposure to ultraviolet (UV) radiation are particularly difficult to clean without high-VOC solvents. UV-curable inks are considered "100% solid systems" in that they contain only pigment and acrylate monomers; although they are not dry (having, instead, a paste-like viscosity), they do not contain solvents. The "diluent monomers" and "resin prepolymers/oligomers" (which are either epoxy acrylates, polyester acrylates or polyurethane acrylates) found in these inks are not used in typical heat-set or cold-set inks, and make UV-curable inks difficult to clean with typical low-VOC cleaning compositions.

SUMMARY OF THE INVENTION

It has been found that low-VOC cleaning compositions containing particular combinations of ingredients are effective in removing stubborn UV-curable inks from printing-press components. In particular, it has been found that combining certain non-ionic surfactants with a miscible organic solvent, and in some cases with the addition of a terpene such as D-limonene, results in compositions that can be formulated to exhibit low VOC content (e.g., less than 100 g/L) while effectively removing UV-curable ink. Indeed, a composition comprising or consisting essentially of a non-ionic surfactant and a terpene such as D-limonene may exhibit sufficient cleaning efficacy without the need for a miscible organic solvent.

Accordingly, in a first aspect, the invention relates to a cleaning composition comprising at least one non-ionic surfactant selected from the group consisting of a sorbitan ester, an ethoxylated sorbitan ester, an ethoxylated castor oil, polyethylene glycol ester and an alcohol ethoxylate; and at least one organic solvent miscible therewith, wherein the cleaning composition has a VOC limit less than 100 g per liter. The composition desirably solvates acrylate-containing, UV-curable ink (which may consist essentially of pigment and acrylate monomers).

The organic solvent(s) may comprise or consist essentially of ethylene glycol or propylene glycol or a derivative thereof, e.g., an ester of ethylene glycol or propylene glycol with at least one acid having six or fewer carbon atoms; and/or or an ether of at least one of ethylene glycol, diethylene glycol or propylene glycol with at least one alkyl group having six or fewer carbon atoms. For example, the ether may be 2-ethoxyethanol or 2-butoxyethanol, or dipropylene glycol monomethyl ether. In some embodiments, the organic solvent(s) comprise or consist essentially of the reaction product of phenol with at least one of ethylene oxide or propylene oxide, e.g., dypropylene glycol monomethyl ether. In one embodiment, the organic solvent(s) comprise or consist essentially of propylene carbonate.

In various embodiments, the surfactant has a hydrophilic-lipophilic balance exceeding 10.5. For example, the surfactant may be DeMULS DLN-2314. In some embodiments, the composition has a viscosity no greater than 250 cps. When applied to a rubber roller, the composition may swell the roller no more than 3.5% by weight in two hours.

In some embodiments, the composition includes D-limonene, and in some formulations, one or more of an animal-based oil, a vegetable-based oil, and/or water.

In another aspect, the invention relates to a cleaning composition comprising at least one non-ionic surfactant selected from the group consisting of a sorbitan ester, an ethoxylated sorbitan ester, an ethoxylated castor oil, polyethylene glycol ester and an alcohol ethoxylate; and D-limonene, wherein the cleaning composition has a VOC limit less than 100 g per liter. In some embodiments, the composition includes a miscible organic solvent selected from the group consisting of dipropylene glycol monomethyl ether and propylene carbonate. The composition may further comprise an animal-based oil, a vegetable-based oil, and/or water.

In yet another aspect, the invention relates to a method of removing residual ink from components of a printing press. The method comprises the steps ofsolvating the residual ink by applying to the components a composition comprising (i) at least one non-ionic surfactant selected from the group consisting of a sorbitan ester, an ethoxylated sorbitan ester, an ethoxylated castor oil, polyethylene glycol ester and an alcohol ethoxylate and (ii) a carrier, wherein the composition has a VOC limit less than 100 g per liter, and removing the solvated residual ink. The carrier may comprise an organic solvent miscible with the surfactant, D-limonene, or both. The ink may be acrylate-containing, UV-curable ink (which may consist essentially of pigment and acrylate monomers).

Solvated residual ink may be removed mechanically and/or by rinsing. The rinsing step may comprise repetition of the solvating step followed by application of water.

It should be stressed that, as used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

The term "high-solids ink" means an ink that is substantially free of solvent, e.g., an ink containing only pigment and curable monomeric components.

"Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

The term "substantially" means±10% (e.g., by weight or by volume), and in some embodiments, ±5%. The term "consists essentially of" means excluding other materials that contribute to function. For example, a cleaning fluid having a solvent for silicone that consists essentially of alcohol contains no other material functioning as a solvent for silicone, although it may contain ingredients that do not contribute to this function.

DETAILED DESCRIPTION

Compositions in accordance with the present invention cleaning composition for removing ink from printing press rollers include one or more non-ionic surfactants found to enhance cleaning performance in combination with a carrier, which may include or consist essentially of miscible organic solvent or a terpene such as D-limonene or both. Preferred non-ionic surfactants include, alone or in combination with one or more of the others: one or more sorbitan esters, one or more ethoxylated sorbitan esters, one or more ethoxylated castor oils, one or more polyethylene glycol esters and/or one or more alcohol ethoxylates. Chemical formulas for these components are as follows:

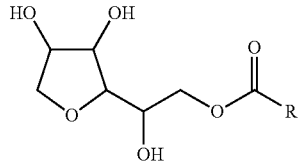

$R = C_{11}H_{23}$

Sorbitan ester

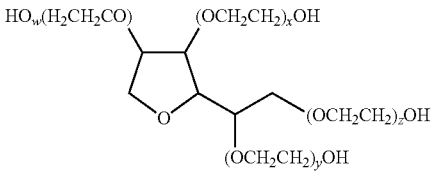

Sorbitan ethoxylate

-continued

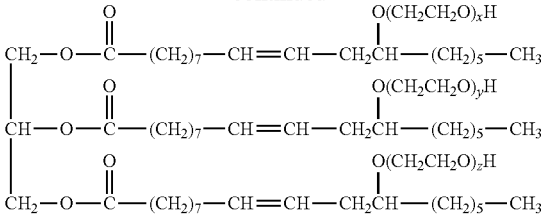

Ethoxylated Castor Oil

Alcohol ethoxylates have the chemical formula $CH_3(CH_2)_mO(CH_2CH_2O)_nH$ and polyethylene glycol monoesters have the chemical formula $CH_3(CH_2)_mCOO(CH_2CH_2O)_nH$. For some applications, ethoxylated sorbitan ester, polyethylene glycol ester and/or alcohol ethoxylate may be preferred.

Sorbitan esters include derivatives in which the total number of ethylene oxide units ranges from 3 to 30; in which the total number of ethylene oxide units is 4, 5, or 20; and/or in which the capping acid is laurate, palmitate, stearate, or oleate. The sorbitan derivative may be a polyoxyethylene (POE) sorbitan monolaurate; a POE sorbitan dilaurate; a POE sorbitan trilaurate; a POE sorbitan monopalmitate; a POE sorbitan dipalmitate; a POE sorbitan tripalmitate; a POE sorbitan monostearate; a POE sorbitan distearate; a POE sorbitan tristearate; a POE sorbitan monooleate; a POE sorbitan dioleate; a POE sorbitan trioleate; POE (20) sorbitan monolaurate; POE (4) sorbitan monolaurate; POE (20) sorbitan monopalmitate; POE (20) monostearate; POE (20) sorbitan monostearate; POE (4) sorbitan monostearate; POE (20) sorbitan tristearate; POE (20) sorbitan monoleate; POE (20) sorbitan 15 monoleate; POE (5) sorbitan 10 monoleate; and/or POE (20) sorbitan trioleate. Specific examples include ALKAMULS SML, ALKAMULS SMO, and ALKAMULS STO, available from Rhodia, Inc.; TWEEN 21, TWEEN 40, TWEEN 60, TWEEN 60 K, TWEEN 61, TWEEN 65, TWEEN 80, TWEEN 80 K, TWEEN 81, and TWEEN 85, available from Croda Inc. (Edison, N.J.).

Alcohol ethoxylates are produced by the reaction of ethylene oxide with fatty alcohols. The alcohol reacts with ethylene oxide at the hydroxyl group to provide an ether linkage and a new hydroxyl group. Several generic names are given to this class of surfactants, such as ethoxylated fatty alcohols, alkyl polyoxyethylene glycols, monoalkyl poly(ethylene oxide) glycol ethers, etc. A typical example is dodecyl hexaoxyethylene glycol monoether with the chemical formula $C_{12}H_{25}O(CH_2CH_2O)_6H$ (sometimes abbreviated C12E6). In practice, the starting alcohol will have a distribution of alkyl chain lengths and the resulting ethoxylate will have a distribution of ethylene oxide chain lengths. Thus, the numbers listed in the literature generally refer to average numbers. Examples of liquid alcohol ethoxylates include the NATSURF and SYNPERONIC emulsifier series available from Croda, Inc. (Edison, N.J.), and the Lumulse L-4 and L-7 ethoxylated lauryl alcohols available from Lambent Technologies Inc. (Gurnee, Ill.)

Castor oils are unique triglycerides having about 90% of ricinoleic acid (12-hydroxyoleic acid) chains. Ricinoleic acid is an 18-carbon hydroxylated fatty acid with one double bond. The hydroxyl groups in castor oils account for a combination of properties including relatively high viscosity, solubility in alcohols, and provide reaction sites for chemical derivatization. Castor oil ethoxylates are produced by the reaction of ethylene oxide primarily at the hydroxyl groups of the molecule, but in addition may also occur at the ester group. The ethoxylated products, also called Polyoxyl Castor Oil, Polyoxyl n Castor Oil, Polyethylene Glycol Castor Oil, Castor Oil Ethoxylates and Polyethoxylated Castor Oil, are non-ionic surfactants that have found widespread industrial applications as emulsifiers and solubilizers. The principal chemistry of these emulsifiers is shown in the above formula, where (x+y+z) is the total molar addition of ethylene oxide per molecule of castor oil. This parameter, known as the degree of ethoxylation, is used for the identification of the commercial range of products available from different companies. Examples of liquid products are the standard products ETOCAS 5, 10, 29, 35, and 40 from Croda Inc. (Edison, N.J.) and the LUMULSE CO-5, CO-25, and CO-40 series available from Lambent Technologies Inc. (Gurnee, Ill.).

Polyethylene glycol (PEG) esters are the product of the reaction between a mono- or diester of a fatty acid and a polyethylene glycol. These are produced either by direct esterification of a propylene glycol with fatty acids or by trans-esterification of a propylene glycol with oils or fats. Low-molecular-weight PEG esters are oil-soluble and are useful in connection with non-aqueous systems. The high-molecular-weight products are water-soluble, making them suitable for use in aqueous systems. PEGs with molecular weights between 200 and 1450 are the most versatile for emulsification applications in aqueous systems. The commercial products are usually identified by the name of the starting fatty acid and the molecular weight of the PEG chain. Specific examples of liquid mono- and diesters are found in the LUMULSE PEG ester series available from Lambent Technologies, Inc.: LUMULSE 40-L (PEG-400 monolaurate), LUMULSE 40-OK (PEG-400 monooleate), LUMULSE 40-T (PEG-400 monotallate), LUMULSE 42-OK (PEG-400 diolate), LUMULSE 42-T (PEG-400 ditallate), LUMULSE 62-TK (PEG-600 ditallate), and LUMULSE 62-OK (PEG-600 diolate).

The composition may contain, as additional ingredients, one or more of (i) an animal-based oil, (ii) a vegetable-based oil and/or (iii) water. In some embodiments, the composition contains as the surfactant one or more of DeMULS DLN-532CE, DeMULS DLN-2314, and DeMULS DLN-622EG, available from DeForest, Boca Raton, Fla. These are 97%-active emulsifiers that can be used to produce clear D-limonene emulsion concentrates containing as much as 50% D-limonene.

Suitable miscible organic solvents include the reaction products of phenol with ethylene oxide and propylene oxide such as ethylene glycol phenyl ether (phenoxyethanol), esters of ethylene glycol and of propylene glycol with acids having six or fewer carbon atoms, and ethers of ethylene glycol, diethylene glycol, and of propylene glycol with alkyl groups having six or fewer carbon atoms, such as 2-ethoxyethanol and 2-butoxyethanol. A single organic solvent or a mixture of organic solvents can be used. Suitable miscible organic solvents include DOWANOL DPM (dipropylene glycol monomethyl ether) and propylene carbonate. Propylene carbonate especially useful due to its low toxicity and VOC-exempt status.

An example of a useful composition containing at least one organic solvent is:

| | |
|---|---|
| DeMULS DLN-2314 | 66 to 95% |
| Propylene carbonate | 5 to 25% |
| D-limonene | 0 to 9% |

Preferred working ranges include:

| | |
|---|---|
| DeMULS DLN-2314 | 73 to 85% |
| Propylene carbonate | 10 to 18% |
| D-limonene | 5 to 9% |

The cleaning composition desirably has a VOC limit of less than 100 g/L of cleaning composition. The HLB (hydrophilic-lipophilic balance) of the surfactant of the cleaning composition should be greater than 10.5, preferably between 12.5 and 18. The HLB value is a measure of the relationship (or balance) between the hydrophilic and lipophilic portions of non-ionic surfactants. The HLB system provides a quantitative way of correlating the chemical structure of non-ionic surfactants with their surface activities. This was originally developed for ethoxylated products to predict the emulsification properties and solubility of surfactants that contain water-soluble groups derived from ethylene oxide. In the majority of non-ionic surfactants, the hydrophilic portion of the molecule is a polyether, consisting of oxyethylene units and made by the polymerization of ethylene oxide; a fatty acid or a fatty alcohol is the lipohilic part of the molecule. The length of the ethylene oxide chain determines the hydrophilic characteristics of the surfactant.

The HLB value is the molecular weight percent of the hydrophilic portion of a non-ionic surfactant divided by five. The calculated value may be used as an indicator of a surfactant's emulsifying behavior and its solubility in water. At the high end of the scale (8-18) lie hydrophilic surfactants, which are highly soluble in water and generally act as good aqueous solubilizing agents, detergents and stabilizers for oil-in-water emulsions; at the low end (3-6) are surfactants with low water solubility, which act as solubilizers of water-in-oil mixtures. In the middle are compounds that are surface-active, in terms of lowering surface and interfacial tensions, but generally perform poorly as emulsion stabilizers, possibly because of their balanced solubility characteristics in the two phases.

Desirably the cleaning composition has a viscosity less than 250 centipoise, preferably less than 100 centipoise, most preferably less than 50 centipoise, which facilitates dispensing of the composition through automatic cleaning devices (pumps and tubes, for example), though manual application to rollers is of course possible as well.

Another desirable property of the cleaning compositions relates to the rubber materials typically used on printing press rollers. Cleaning compositions should not cause any appreciable changes to the mechanical and physical properties of the rubber material of the roller. The impact of the cleaner composition on the rollers can be assessed by measuring weight changes due to solvent penetration and swelling of rubber samples exposed to the cleaning compositions for a given length of time. As a reference parameter, the maximum allowed weight change due to rubber swelling is set as the change (+1%) produced by high-VOC commercial cleaning products currently in use for this cleaning application. For example, samples of rubber from a Trust WL Roller (Techno Roll Co., Ltd.) undergo a weight increase of about +2.5% when soaked for two hours in the high-VOC product Böttcherin Offset UV supplied by Böttcher America Inc. (Belcamp, Md.). The weight increases caused by cleaning compositions in accordance herewith have swelling levels of 3.5% or less.

EXAMPLES

Examples 1-4

A series of cleaning solutions having VOC levels below 100 g/L were prepared according to the following formulations, in parts by weight:

| Components | Parts | | | |
|---|---|---|---|---|
| | Example 1 | Example 2 | Example 3 | Example 4 |
| DeMULS DLN2314 | 0.93 | 0.93 | 0.93 | 0.825 |
| d-limonene | 0.07 | — | 0.02 | 0.025 |
| Dowanol DPM | — | 0.07 | 0.05 | 0.050 |
| Water | — | — | — | 0.100 |

DeMULS DLN2314 is a proprietary blend of modified ethoxylates available from DeForest Enterprises, Inc. (Boca Raton, Fla.). According to manufacturer information, this emulsifier has a measurable VOC content of 31.98 g/L, but does not contain ozone depleting substances or solvents. D-limonene (4-isopropenyl-1-methyl-1-cyclohexane) is a biodegradable terpene solvent, occurring in nature as the main component of orange peel oil, that is frequently used as a replacement of petroleum-derived solvents. This is a naturally occurring VOC with a reported VOC content of 851 g/L. A high-purity grade (99.7%) D-limonene product supplied by Millennium Specialty Chemicals Inc. (Jacksonville, Fla.) was used for this work. Dowanol DPM (Dipropylene glycol methyl ether) is a high-VOC glycol ether solvent (VOC of 950 g/L) supplied by Sigma-Aldrich (Saint Louis, Mo.).

A complete evaluation of the performance of these solutions includes the following: determination of VOC content, ink compatibility, viscosity, and swelling effect on the rubber material used on press rollers. The total VOC content of the cleaning solutions is given as the weight of VOC in grams per volume (in liters) of solution (g/L). The calculated values included herein represent the sum of the contributions, by parts, of the VOC components of the solution.

One of the most desirable properties of the present compositions is their compatibility or miscibility with UV waterless inks. Ink compatibility was determined with the Sahara & Nevada Classicure waterless UV inks manufactured by Classic Colours Inks (Reading, UK). Evaluation of ink compatibility includes at least one of the following:

a) Laboratory test: A sample, about 1.0 g, of UV waterless ink is thoroughly mixed with 10 g of the cleaning solution. The resulting mixture is allowed to settle for two hours, and is then visually inspected for any evidence of pigment separation. Pigment separation is taken as an indication of failure or incompatibility of the ink with the solution. The results of the test are classified in three categories: Good (homogeneous mixture without pigment separation), Fair (very slight pigment separation after two hours of test), and Poor (pigment separation observed from beginning of test). Subsequent evaluation, such as the on-press procedures described in (b) and (c) are carried out on solutions that pass this preliminary test.

b) On-press manual rinsing test: The cleaning solution is used to clean the rollers of the Presstek 52DI UV digital printing press. This is a two-step cleaning procedure where the inked rollers are first rinsed repeatedly with the cleaning solution, dispensed from a squeeze bottle, until the ink is almost completely removed. In a second step, excess cleaner is removed by repeated rinsing with tap water. The test is considered successful if the cleaning procedure does not lead to pigment separation from the inks, and further visual inspection of the rollers does not reveal signs of pigment deposition. To confirm results, a print job is run after the cleaning procedure to verify that printing sheets do not show any background toning. Background toning is defined as the inability of the non-image portions of a printing plate surface to fully reject ink; the final work product looks "dirty," with unwanted ink contaminating non-image areas.

c) Test on-press with automatic roller cleaner unit: This test procedure is limited to cleaning solutions that pass the manual cleaning test (b). The cleaning solution is loaded and used on the automatic cleaning unit of the Presstek 52DI UV press. An acceptable result occurs when pigment separation on the rollers is not observed (by visual inspection of the rollers after cleaning), yielding subsequent print jobs without background toning.

The viscosity of a cleaning solution is measured at 24° C. on a Brookfield DV III Ultra Rheometer manufactured by Brookfield Engineering Laboratories, Inc. (Middleboro, Mass.). Viscosities reading were obtained at shear rates that give torque readings higher than 10%. Low-viscosity solutions are mainly desirable for on-press cleaning with automatic cleaning units, where the high viscosity fluids are more difficult to handle.

The swelling test indicates the possible impact of the cleaning solution on the physical properties of the rubbers used on the press form rollers. The rollers (Trust WL Rollers) are made of a rubber compound of proprietary composition manufactured by Techno Roll Co., Ltd. (Osaka, Japan). The test is based on measurements of percentage weight changes on a 0.5 g piece of roller rubber immersed in 10 g of the cleaning solution for two hours. The weight change caused by the high-VOC commercial product Böttcherin offset UV supplied by Böttcher America Inc. (Belcamp, Md.) is used as a reference. The test results are classified as follows: Low (weight increase lower than 2%), Medium (weight increase between 2% and 3.5%), and High (weight increase higher than 3.5%). "Low" to "medium" results are considered acceptable while "High" is not acceptable.

The cleaning formulations of Examples 1-4 have calculated VOC levels less than 100 g/L. In addition, all solutions display acceptable performance for the tests described above. The observations are summarized in the following table:

| Property | Example 1 | Example 2 | Example 3 | Example 4 |
|---|---|---|---|---|
| VOC (g/L) | 89 | 96 | 94 | 95 |
| Lab. ink compatibility test | Good | Good | Good | Good |
| Viscosity (cps) | | | 53 | 34 |
| Swelling | Low | Low | Low | Low |

The disclosed cleaning solutions are effective in removing UV waterless inks from the rollers of the Presstek 52DI UV press. The solutions pass the laboratory ink compatibility test carried out with UV waterless inks. Some performance differences are observed when the solutions are used for on-press cleaning either manually or with automatic cleaning. In particular, there are differences in the speed of cleaning or cleaning efficiency of these solutions, which vary according to the following order:

Example 4<Example 1<Example 2<<Example 3

Cleaning efficiency is based on visual inspection of the cleanliness of the rollers, and refers to the numbers of rinses (manual cleaning) or cleaning cycles (automatic cleaner) required for complete cleaning of the press rollers with a given solution. The most efficient or faster solutions require the use of less solution (i.e., a smaller number of rinses/cycles) to clean the press rollers. This is a limiting factor only for on-press automatic cleaning applications. It may not make any difference for off-press manual cleaning applications.

The relatively small amounts of D-limonene and Dowanol DPM help to dissolve and disperse ink resins and pigments, and therefore enhance the cleaning efficiency or speed of the solutions. Example 3, with the combined solvents, is the most efficient of the series and Example 4, with water addition, is the slowest of the series. Therefore, the addition of water degrades the efficiency of cleaning UV waterless inks.

The water formulation of Example 4 displays good performance on the "laboratory" test. However, the addition of a large amount of water to this cleaning formulation leads to excessive ink pigment separation in UV waterless inks, degrading the performance of the cleaning solution. Example 4, using 10% water addition, yields slight separation of ink pigment of some ink colors after repeated use on press with the automatic cleaner unit. Cleaner formulations with water concentrations higher than 10% display major ink incompatibility issues and therefore are not acceptable for use with the UV waterless inks. However, this does not preclude the utilization of the water formulations for other applications with conventional drying waterless and other lithographic inks.

The viscosity measurements, confirm that the addition of the solvents and water helps to reduce the viscosity of the solution. The viscosity of the series increases as follows:

Example 1≅Example 2≅Example 3>Example 4

The disclosed formulations have relatively high concentrations of the DeMULS DLN2314 emulsifier. The viscosity of the pure emulsifier is about 78 cps, and the addition of solvents in Example 3 brings viscosity down to about 54 cps. The addition of water in Example 4 provides further reduction of viscosity. All solutions display acceptable performance for the swelling test, yielding weight percentage changes lower than those measured with the commercial cleaning solution. Therefore, these solutions can be safely used for everyday cleaning of press rollers.

Examples 5-7

Cleaning solutions with VOC contents below 100 g/L were prepared with the VOC-exempt solvent propylene carbonate according to the following formulations given in parts by weight:

| | Parts | | |
|---|---|---|---|
| Components | Example 5 | Example 6 | Example 7 |
| DeMULS DLN2314 | 0.77 | 0.72 | 0.67 |
| d-limonene | 0.08 | 0.08 | 0.08 |
| Propylene Carbonate | 0.15 | 0.20 | 0.15 |
| Water | — | — | 0.10 |

Propylene carbonate (1,2 propanediol cyclic carbonate) is an organic solvent that is not regulated as a VOC by the EPA and the South Coast Air Quality Management District (SCAQMD). It is a clear polar solvent having high flash and boiling points, low toxicity, and about 20% water solubility. The 99% purity product supplied by Alfa-Aesar (Ward Hill, Mass.) was used for this work.

The following formulations were evaluated following the same procedure described for Examples 1-4.

| Property | Example 5 | Example 6 | Example 7 |
|---|---|---|---|
| VOC (g/L) | 92 | 92 | 89 |
| Lab. ink compatibility test | Good | Good | Good |
| Viscosity (cps) | 29 | 18 | |
| Swelling | Low | Medium | Low |

The VOC-exempt grading of propylene carbonate allowed the addition of larger amounts of solvent to the formulations without exceeding the 100 g/L limit. This provides increased cleaning efficiency and lower viscosity.

All solutions pass the ink compatibility evaluation, and the on-press test shows the following order of cleaning efficiency or speed:

Example 7<Example 5<Example 6

Furthermore, the cleaning efficiency of Examples 5 and 6 is better than that obtained with the Dowanol DPM-based solution of Example 3. The addition of water in Example 7 causes limitations similar to those described for Example 4 with UV waterless inks. Likewise, this formulation may be utilized with conventional waterless and other inks.

The standard swelling test described above was done with these solutions. It was verified that the cleaning solutions of Example 5 and Example 7 cause "low" swelling effects, while Example 6 causes medium swelling effects, which are about twice of that measured with formulation of Example 5 and comparable to that produced by the commercial product Böttcherin offset UV. Therefore, Example 6 is a desirable fast cleaner with low viscosity but might have a greater impact on the life of the press rollers.

In summary, Examples 5 and 6 are efficient low viscosity formulations that could be used in the automatic cleaning unit of the Presstek 52DI UV digital and other commercial printing presses.

Examples 8-12

A series of cleaning solutions was prepared with sorbitan ester and ethoxylated sorbitan ester surfactant blends having HLB values higher than 11. The surfactants TWEEN 80, TWEEN 20, and SPAN 20 supplied by Sigma-Aldrich (Saint Louis, Mo.) were used as emulsifiers in cleaning solutions having compositions similar to that of Example 5. In these formulations, the commercial product DeMULS DLN2314 is replaced with the sorbitan-based chemistry while keeping the same concentrations of the other ingredients: 0.08 parts D-limonene and 0.15 parts of propylene carbonate.

SPAN 80 is a sorbitan ester (sorbitan monooleate) with a reported HLB value of 4.3. TWEEN 20 (polyoxyethylene(20) sorbitan monolaurate) and TWEEN 80 (polyoxyethylene(20) sorbitan monooleate) are ethoxylated sorbitan esters with mole ethoxylation levels of twenty and with reported HLB values of 16.7 and 15, respectively. Emulsifier blends with HLB values lower than 15 were prepared by mixing SPAN 20 and TWEEN 80 as indicated below:

Blend 1 (HLB 14): 9% Span 80/91% Tween 80
Blend 2 (HLB 12): 28% Span 80/72% Tween 80
Blend 3 (HLB 10): 46% Span 80/54% Tween 80

The performance of the cleaning solutions is evaluated as described for Examples 1-4, and the main observations summarized in the following table.

| Property | Example 8 | Example 9 | Example 10 | Example 11 | Example 12 |
|---|---|---|---|---|---|
| VOC (g/L) | 68 | 68 | 68 | 68 | 68 |
| Emulsifier | Tween 20 | Tween 80 | Blend 1 | Blend 2 | Blend 3 |
| HLB | 16.7 | 15 | 14 | 12 | 10 |
| Lab. ink compatibility test | Good | Good | Good | Fair | Poor |
| Viscosity (cps) | 138 | 171 | | 162 | 161 |
| Swelling | Low | Low | Low | Low | Low |

The emulsifiers do not contribute to the VOC content of the formulation, so the calculated VOC content of Examples 8 to 12 is well below 100 g/L and determined by the contribution of the D-limonene solvent (68 g/L).

The compatibility of UV waterless inks with this type of cleaning solutions depends on the HLB value of the emulsifier: The sorbitan ester/ethoxylated sorbitan ester emulsifiers with HLB values lower than 12 gave cleaning solutions that are not fully compatible with the UV waterless inks. However, this does not limit the potential use of these formulations with conventional drying waterless inks and other inks.

The solutions of Examples 8 to 10 have relatively high viscosities and cause minimum swelling effects on the material used on the press form rollers. These high-viscosity solutions may find limited applications for on-press use with automatic cleaning units, but are acceptable for manual off-press roller cleaning applications.

Examples 13-15

Cleaning solutions of composition similar to that of Example 5 were made with ethoxylated castor oil emulsifiers LUMULSE CO-25 and LUMULSE CO-40 (available from Lambent Technologies Inc., Gurnee, Ill.), replacing the DeMULS DLN2314. These are castor oil derivatives with 25 and 40 mole ethoxylation levels and reported HLB values of 10.8 and 13.0, respectively. An additional cleaning solution, made with a blend of 54% LUMULSE CO-40 and 46% LUMULSE CO-25 (Example 15) provides an intermediate calculated HLB value of about 12.

The cleaning solutions exhibit satisfactory performance as shown in the following table:

| Properties | Example 13 | Example 14 | Example 15 |
|---|---|---|---|
| VOC (g/L) | 91 | 91 | 91 |
| Emulsifier | Lumulse CO-25 | Lumulse CO-40 | Blend |
| HLB | 10.8 | 13 | 12 |
| Lab. ink compatibility Test | Good | Good | Good |
| Viscosity (cps) | 196 | 221 | 215 |
| Swelling | Low | Low | Low |

According to manufacturer information, the LUMULSE CO products have a maximum reported VOC content of 0 to 3% by volume (maximum of about 30 g/L). Assuming the maximum content, the calculated VOC content of Examples 13 to 15 is in the order of 91 g/L.

In summary, the castor oil emulsifiers produce relatively high-viscosity roller cleaning solutions that are compatible with UV waterless inks and cause minimal swelling effects on the material used on the press form rollers. The high-viscosity solutions may find limited applications for on-press cleaning with automatic cleaning units, but could be acceptable for manual off-press roller cleaning applications.

Example 16

A roller cleaning solution of composition similar to that of Example 5 was prepared with a PEG ester emulsifier, LUMULSE 40-L (supplied by Lambent Technologies Inc., Gurnee, Ill.), replacing the DeMULS DLN2314. LUMULSE 40-L, PEG-400 monolaurate, is a non-ionic emulsifier produced through the esterification of high-purity lauric acid. This is a non-VOC emulsifier with a reported HLB value of 12.8. The properties of the solution are summarized below:

| Properties | Example 16 |
|---|---|
| VOC (g/L) | 68 |
| Lab. ink compatibility Test | Good |
| Viscosity (cps) | 35 |
| Rubber swelling | Low |

The calculated VOC content of Example 16 is in the order of 68 g/L. The solution presents a combination of desirable properties: it is compatible with UV waterless inks, has viscosities within the most desirable range (below 50 cps), and has low swelling impact on the press form rollers. The cleaning solution of this example may be used on both on-press automatic roller cleaning units and off-press cleaning applications.

Examples 17-19

Cleaning solutions of composition similar to that of Example 5 were prepared with alcohol ethoxylates: NATSURF 125 and NATSURF 265 (emulsifiers available from Croda USA, Inc.) replacing the DeMULS DLN2314. NATSURF 125 and NATSURF 265 are alcohol ethoxylates with different levels of ethoxylation, giving HLB values of 9.6 and 13.6, respectively. These are environmentally friendly surfactants derived from natural primary alcohols.

An additional solution was also prepared by using a 50/50 blend of the two emulsifiers. This blend has a calculated HLB of 11.6. The properties of these cleaning solutions are summarized in the following table:

| Property | Example 17 | Example 18 | Example 19 |
|---|---|---|---|
| VOC (g/L) | 68 | 68 | 68 |
| Emulsifier | Natsurf 125 | Natsurf 265 | Blend 1:1 |
| HLB | 9.6 | 13.6 | 11.6 |
| Lab. ink compatibility test | Poor | Good | Fair |
| Viscosity (cps) | 25 | 16 | 19 |
| Swelling | Low | Low | Low |

The solutions have VOC contents below 100 g/L and low viscosities, and so are favorable for use in commercial on-press cleaning. The compatibility with UV waterless inks is dependant on the HLB value of the surfactant. The solutions of Example 17 and 19, made with emulsifiers having HLB values below 12, show limited compatibility with UV waterless inks. However, this does not limit the potential utilization of these cleaning solutions in connection with conventional curing waterless and other types of inks.

The solution of Example 18 is a low-viscosity formulation that is fully compatible with UV waterless inks and which can be used on both on-press automatic roller cleaning units and off-press cleaning applications.

Although the present invention has been described with reference to specific details, it is not intended that such details should be regarded as limitations upon the scope of the invention, except as and to the extent that they are included in the accompanying claims.

What is claimed is:

1. A method of removing residual UV-curable ink from components of a printing press, the method comprising the steps of:

A. solvating the residual UV-curable ink by applying to the components a composition consisting essentially of:

(i) at least one non-ionic surfactant selected from the group consisting of a sorbitan ester, an ethoxylated sorbitan ester, an ethoxylated castor oil, polyethylene glycol ester and an ethoxylated fatty alcohol; and (ii) a carrier consisting essentially of at least one of:

(a) at least one organic solvent selected from the group consisting of:

(1) the reaction product of phenol with ethylene oxide, (2) the reaction product of phenol with propylene oxide, (3) esters of ethylene glycol or propylene glycol with acids having six or fewer carbon atoms, (4) ethers of ethylene glycol, diethylene glycol, or propylene glycol with alkyl groups having six or fewer carbon atoms, (5) dipropylene glycol monomethyl ether, and (6) propylene carbonate, or (b) D-limonene, or (c) water, wherein the composition has a VOC limit less than 100 g per liter, and B. removing the solvated residual UV-curable ink.

2. The method of claim 1 wherein the UV-curable ink consists essentially of pigment and acrylate monomers.

3. The method of claim 1 wherein the solvated residual UV-curable ink is removed mechanically.

4. The method of claim 1 wherein the solvated residual UV-curable ink is removed by rinsing.

5. The method of claim 1 wherein the composition consists essentially of the at least one non-ionic surfactant and D-limonene.

6. The method of claim 1 wherein the composition consists essentially of the at least one non-ionic surfactant and D-limonene and water.

7. The method of claim 1 wherein the at least one surfactant has a hydrophilic-lipophilic balance exceeding 10.5.

8. The method of claim 4 wherein the rinsing comprises repetition of the solvating step followed by application of water.

* * * * *